United States Patent [19]

Eberly

[11] Patent Number: 4,581,907

[45] Date of Patent: Apr. 15, 1986

[54] PADLOCK PROTECTOR

[76] Inventor: David S. Eberly, 5407 Touraine Dr., Tallahassee, Fla. 32808

[21] Appl. No.: 575,286

[22] Filed: Jan. 30, 1984

[51] Int. Cl.[4] ..... E05B 67/38

[52] U.S. Cl. ..... 70/54; 292/205; 292/281

[58] Field of Search ..... 70/54, 55, 56; 292/104, 292/148, 205, 281, DIG. 32

[56] References Cited

U.S. PATENT DOCUMENTS

| | | | |
|---|---|---|---|
| 3,606,423 | 9/1971 | McCarthy | 292/148 |
| 3,652,114 | 3/1972 | Cady | 292/281 |
| 3,727,438 | 4/1973 | Knaack | 70/56 |
| 3,744,280 | 7/1973 | Brown | 70/54 |
| 3,800,570 | 4/1974 | Kaplan | 70/54 |
| 3,884,057 | 5/1975 | Maurer | 70/54 |
| 4,322,102 | 3/1982 | Lindblom | 70/56 |

*Primary Examiner*—Robert L. Wolfe

*Attorney, Agent, or Firm*—Eugene C. Knoblock

[57] ABSTRACT

A protective device for padlocks applied to interlock relatively shiftable members to which cooperating releasably interfitting retainer parts are anchored, which retainer parts are respectively shaped when interfitting to define a recess to receive the shackle of a padlock which engages and interlocks said interfitting retainer parts and is protected by said parts from unauthorized release by cutting of said shackle.

2 Claims, 21 Drawing Figures

Fig. 17
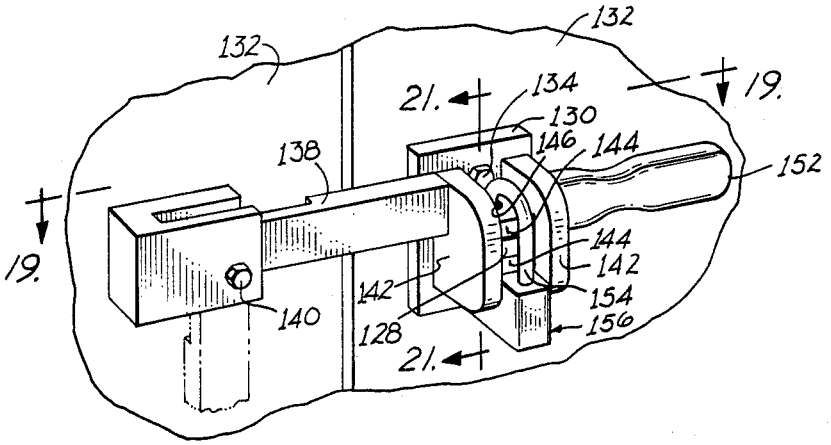
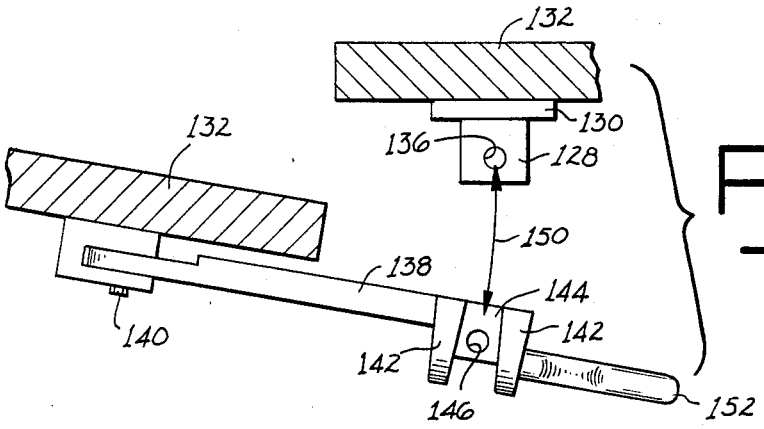
Fig. 18
Fig. 21
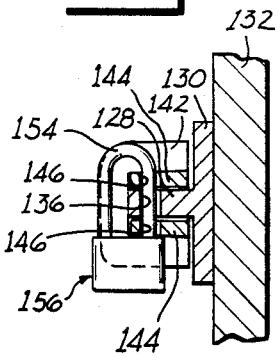
Fig. 19
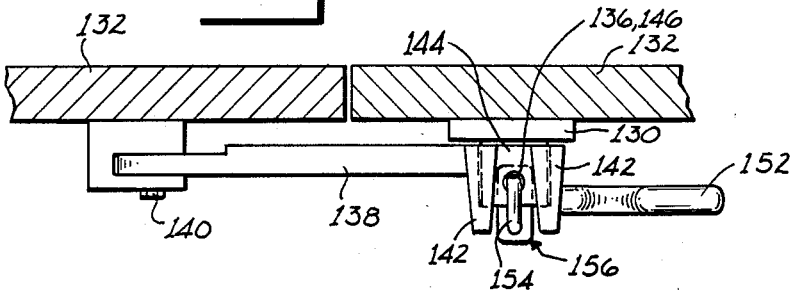
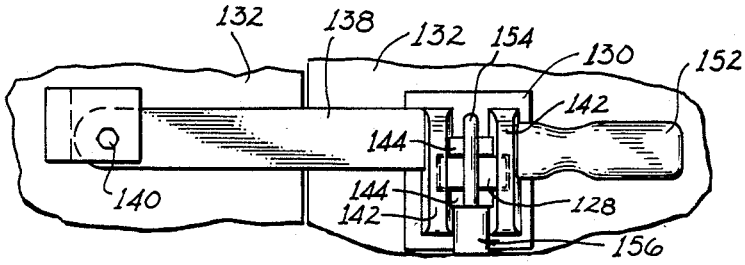
Fig. 20

PADLOCK PROTECTOR

SUMMARY OF THE INVENTION

This invention relates to a protective device for padlocks applied to interlock members at least one of which is shiftable, and to which cooperating releasably interfitting retainer parts are anchored. The retainer parts are respectively shaped, when interfitting, to define a recess to receive the shackle of a padlock which engages and interlocks said interfitting retainer parts and is protected by said parts from unauthorized release by cutting of said shackle.

The protective device may take many forms which include spaced retainer portions formed of case hardened steel between which the shackle of a padlock is positioned to prevent access thereto with a bolt cutter or other device. A tongue extends between the retainer portions and cooperates therewith in a manner to lock the retainer portions together when the shackle of the padlock extends through a bore in a retaining member.

Typically, the padlock protector may be used to lock a double door assembly wherein a tongue is pivoted to one door and a retainer portion is secured to the other door in such a manner that, when the tongue fits in the retainer portion and is retained therein by the padlock shackle, the doors will be locked shut.

It is an object of this invention to provide a security device for padlocks which positions the shackle of a padlock to be inacessible to a cutting tool.

Another object is to provide a security device for padlocks which is adapted for use in connection with a double door assembly.

Another object is to provide a padlock protector which is adapted for use to lock clutch and shift levers, steering levers, security gates and other relatively shiftable members, so as to prevent theft.

Another object is to provide a padlock protector which includes retainer members defining a recess to receive the shackle of a padlock in a position to prevent use of a cutting tool to sever the shackle.

Other objects of this invention will become apparent upon a reading of the following description.

BRIEF DESCRIPTION OF THE DRAWINGS

FIG. 17 is a perspective view of another embodiment of the padlock protector in operative locked position.

FIG. 18 is a fragmentary plan view of the padlock protector of FIG. 17 in its open, unlocked position.

FIG. 19 is a view of the padlock protector of FIG. 17 taken in the direction of arrows 19—19 of FIG. 17.

FIG. 20 is an elevational view of the padlock protector of FIG. 17 in its closed, locked position.

FIG. 21 is a sectional view taken along line 21—21 of FIG. 17.

DESCRIPTION OF THE PREFERRED EMBODIMENTS

Figure 1:
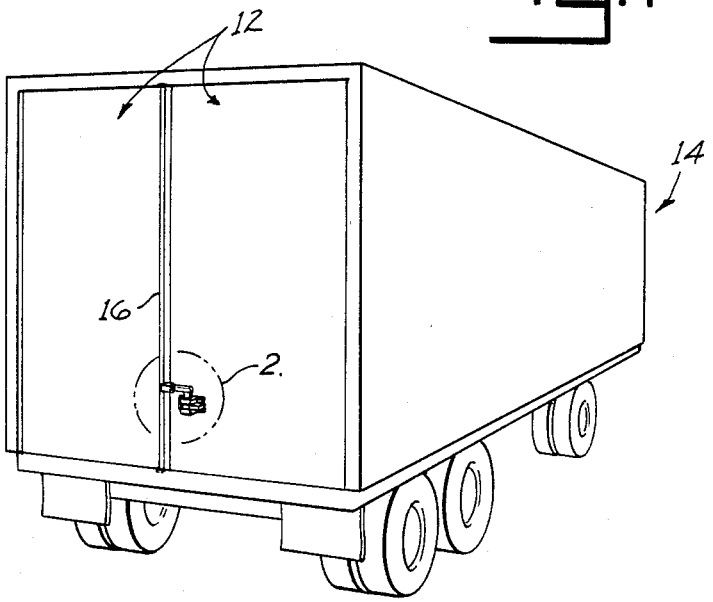
FIG. 1 is a perspective view showing a typical application of the padlock protector of this invention to the double door assembly of a cargo vehicle.
Figure 2:
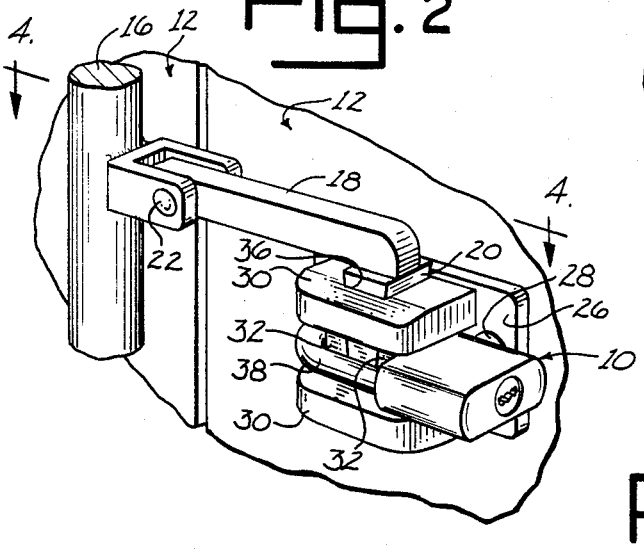
FIG. 2 is an enlarged view of one embodiment of this invention at the area circled in FIG. 1, and shows the locked position of the padlock protector and a padlock.
Figure 3:
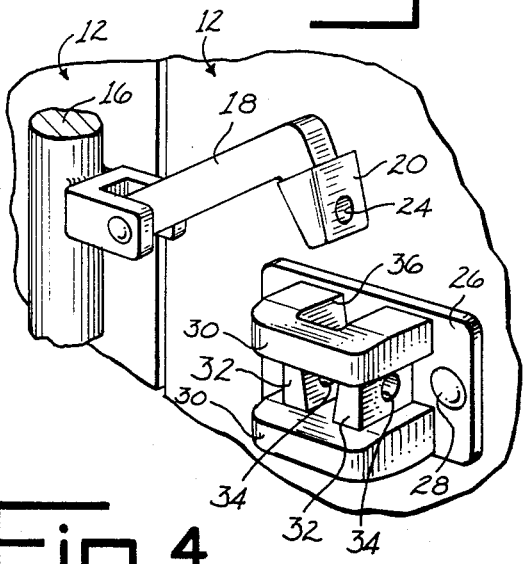
FIG. 3 is a view similar to FIG. 2 showing the padlock removed and the padlock protector in its released state.
Figure 4:
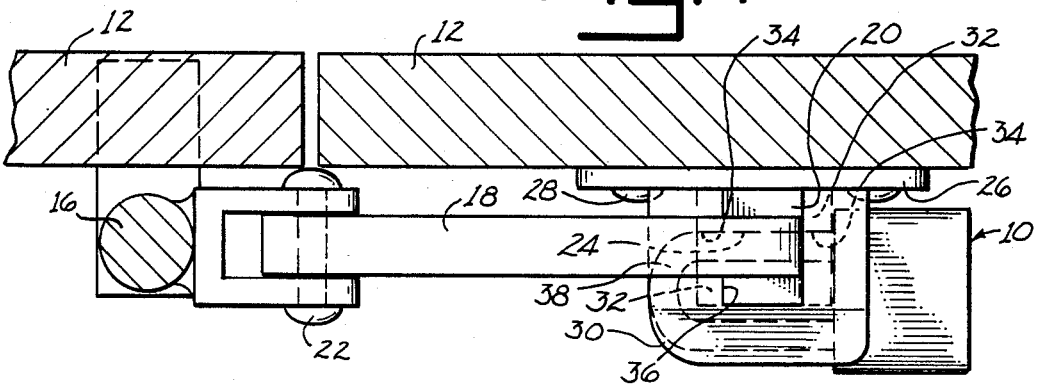
FIG. 4 is a view of the padlock protector of FIG. 2 taken in the direction of arrows 4—4 of FIG. 2.
Figure 5:
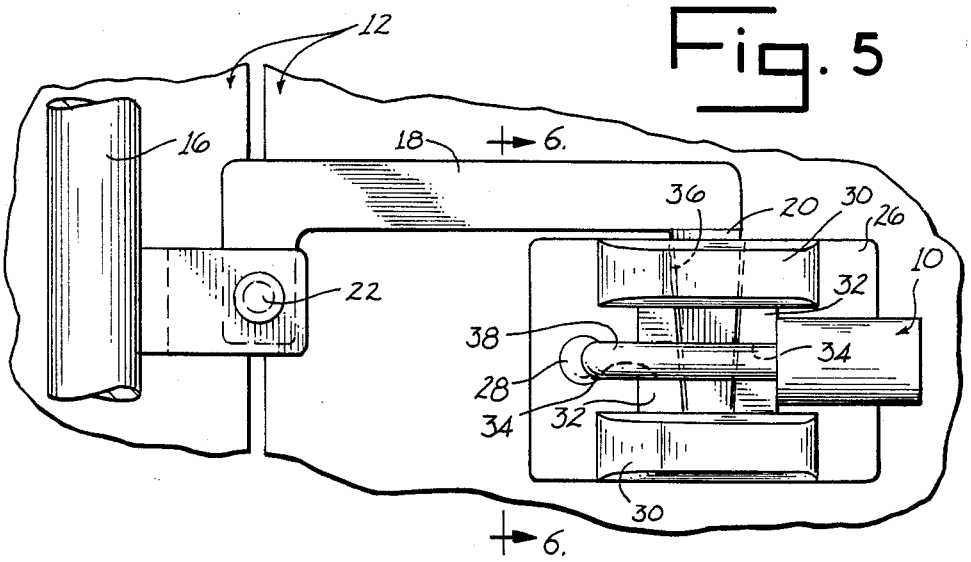
FIG. 5 is an elevational view of the padlock protector of FIG. 2 and shows the padlock protector and the padlock in their respective positions when the doors are closed and locked.
Figure 6:
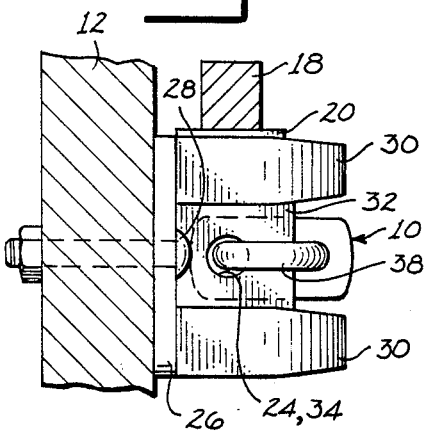
FIG. 6 is a view taken in the direction indicated by arrows 6—6 of FIG. 5.
Figure 7:
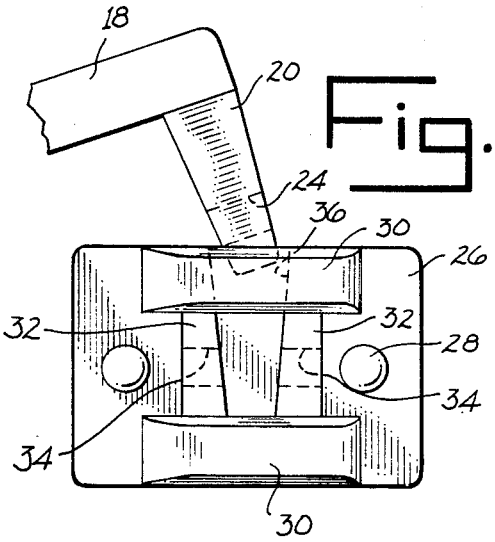
FIG. 7 is a fragmentary elevational view showing the parts of the padlock protector in their disconnected, unlocked positions.

The preferred embodiments illustrated are not intended to be exhaustive or to limit the invention to the precise forms disclosed. They are chosen and described to explain the principles of the invention and its application and practical use, to thereby enable others skilled in the art to utilize the invention.

The embodiment of the padlock protector shown in FIGS. 1–7 has a typical application in protecting a padlock 10 used to lock the double doors 12 of a cargo carrying vehicle 14. The free marginal part of one door 12 carries a vertical bar 16 which rotates about its axis. A retainer tongue 18 having a downturned end portion 20 is hingedly connected to bar 16, as at 22, to pivot in a vertical plane. Tongue end portion 20 has a bore 24 formed therein. The padlock protector includes a retainer having a plate 26 which is secured to the free marginal portion of opposite door 12, as by rivets 28. Vertically spaced horizontal wall portions 30 project from plate 26 and are connected by spaced plates 32. Each plate 32 has a bore 34 formed therein which is aligned with the bore in the other plate. The upper wall portion 30 has an opening 36 formed therein which receives the tongue portion 20. When the padlock protector is in its closed, locking position as illustrated in FIGS. 2, 4–6, tongue end portion 20 is received in wall portion opening 36 and bore 24 thereof is aligned with bores 34 to receive the shackle 38 projecting from the housing of padlock 10. Wall portions 30 are so proportioned relative to plates 32 and bores 24,34 that shackle 38 does not protrude at any point beyond the outlines of the walls 30. Thus, the padlock shackle 38 is inaccessible to a bolt cutter or other cutting device. The parts of the padlock protector are preferably formed of case hardened steel.

Figure 8:
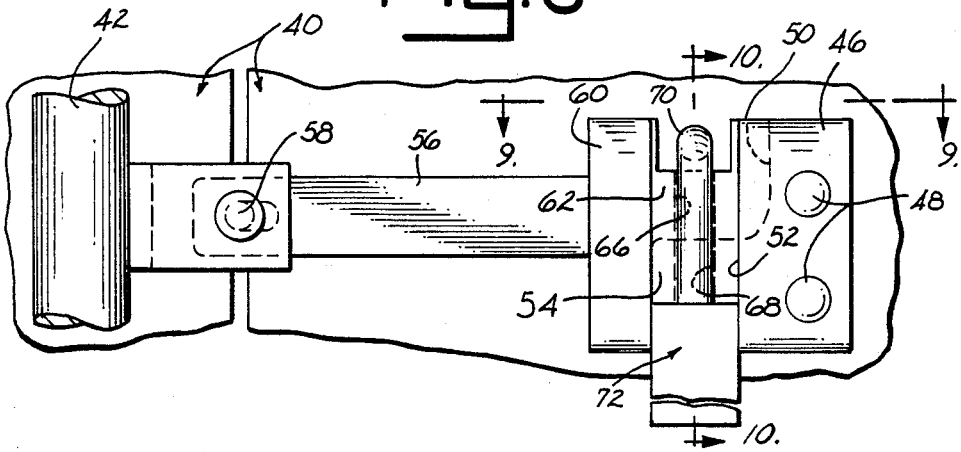
FIG. 8 is an elevational view of a second embodiment of the padlock protector in operative locked position.
Figure 9:
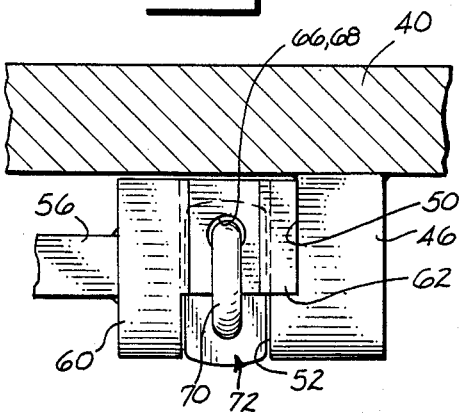
FIG. 9 is a view of the padlock protector of FIG. 8 taken in the direction of arrows 9—9 of FIG. 8.
Figure 10:
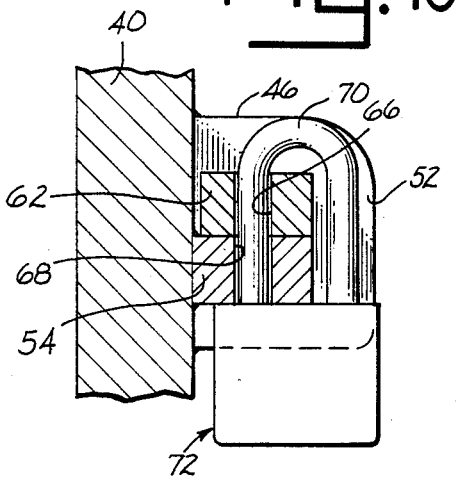
FIG. 10 is a sectional view of the padlock protector of FIG. 8 taken along line 10—10 of FIG. 8.

FIGS. 8–10 illustrate a second embodiment of the padlock protector. The second embodiment is typically useful in securing a set of double doors 40, shown fragmentarily in FIG. 8. One of the doors carries a bar 42 which is vertically mounted on the free marginal portion of the door and rotates about its axis. A retainer member 46 is secured to the free marginal portion of the opposite double door 40, as by rivets 48. Member 46 has a recess 50 formed in its inner face 52. A connector part 54 extends from the inner face 52 beneath recess 50 and is secured to the same door as member 46. A retainer crossbar 56 is hingedly connected to bar 42 as at 58. Crossbar 56 carries an enlarged retainer part 60 which is spaced from the hinge 58 and is alignable with member 46. A U-shaped tongue 62 extends beyond retainer part 60 and fits into recess 50 of member 46. Tongue 62 has a bore 66 formed therein which is alignable with a bore 68 formed in connector part 54. The shackle 70 of a padlock 72 may pass through aligned bores 66,68 so as to secure tongue 62 and crossbar 56 to connector part 54, and thus secure doors 40 in a closed and locked position. Retainer parts 46,60 and U-shaped tongue 62 are of such size and are so proportioned that shackle 70 is positioned and confined between the retainer parts and the tongue, as illustrated in FIGS. 8–10. Thus, shackle 70 is protected from access by a cutting tool.

Figure 12:
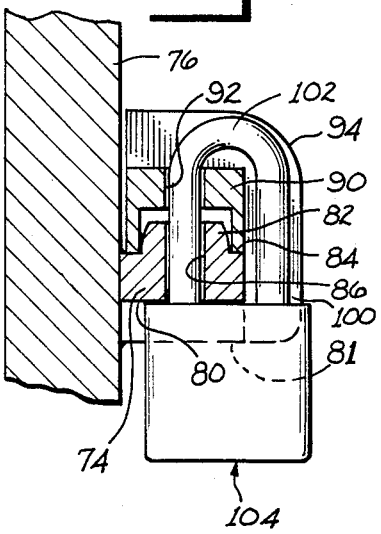
FIG. 12 is a sectional view of the padlock protector of FIG. 11 taken along line 12—12 of FIG. 11.
Figure 11:
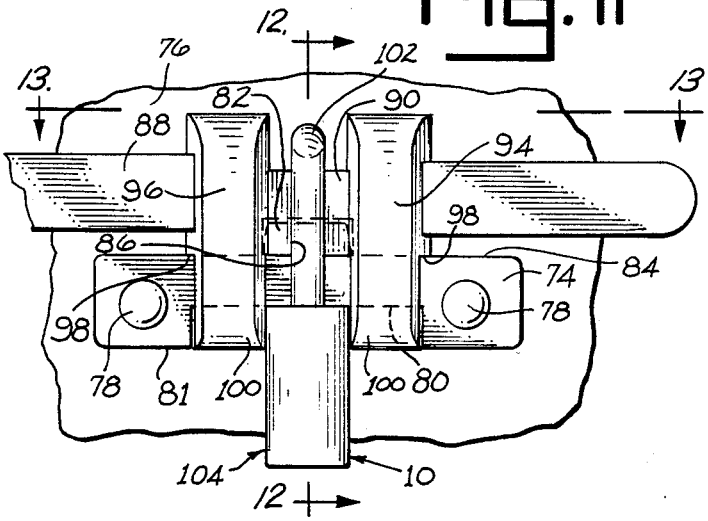
FIG. 11 is an elevational view of a third embodiment of the padlock protector in operative locked position.
Figure 13:
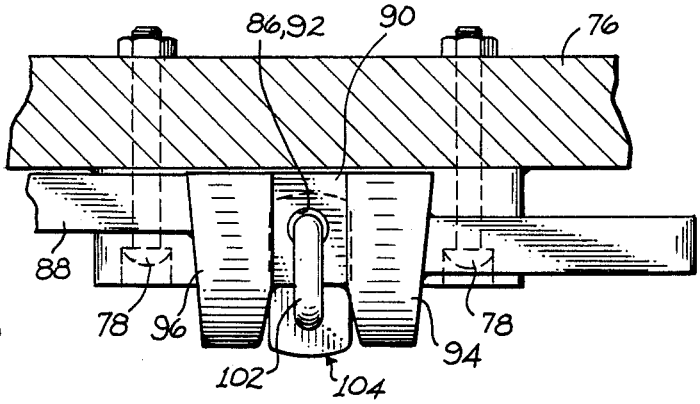
FIG. 13 is a view of the padlock protector of FIG. 11 taken in the direction of arrows 13—13 of FIG. 11.

A third embodiment of this invention is shown in FIGS. 11–13. The padlock protector of this embodiment includes a retainer bar 74 secured to the free margin of one door of a set of double doors 76, illustrated fragmentarily in FIG. 11, as by rivets 78, and includes an inset or recess portion 80 on its lower surface. A raised portion 82 projects from the upper surface 84 of bar 74. A bore 86 is formed in raised portion 82 of bar 74 in communication with recess portion 80. A retainer or crossbar 88 is connected at one end to the free marginal part of the opposite door (not shown) of double door assembly 76 and extends across the intersection of the double doors to overlie bar 74 at its opposite end. Crossbar 88 includes a portion 90 of inverted U-shaped cross section adjacent its free end. A bore 92 is formed in cross bar portion 90 and aligns with bore 86 formed in bar 74 when crossbar 88 overlies the bar 74. Crossbar 88 has depending parts 94,96 spaced apart to receive therebetween the reduced portion 90. Each part 94,96 has a lower shoulder 98 which rests upon the upper surface of bar 74 on opposite sides of raised portion 82. Each part 94,96 projects outwardly from lower surface 98 and includes a portion 100 which extends downwardly as far as lower surface 81 of bar 74. Each portion 100 is located to overlie that portion of bar 74 which includes recessed portion 80. When crossbar 88 overlies bar 74 and bores 86,98 are aligned, the shackle 102 of a padlock 104 may pass through the aligned bores to secure double doors 76 in their closed and locked position. As illustrated in FIGS. 11–13, no portion of shackle 102 extends beyond the outline of projecting parts 94,96, and a portion of the padlock body is received within recessed portion 80 of the bar and is positioned between parts 94,96. In this manner, access to shackle 102 by a cutting tool is prevented.

Figure 14:
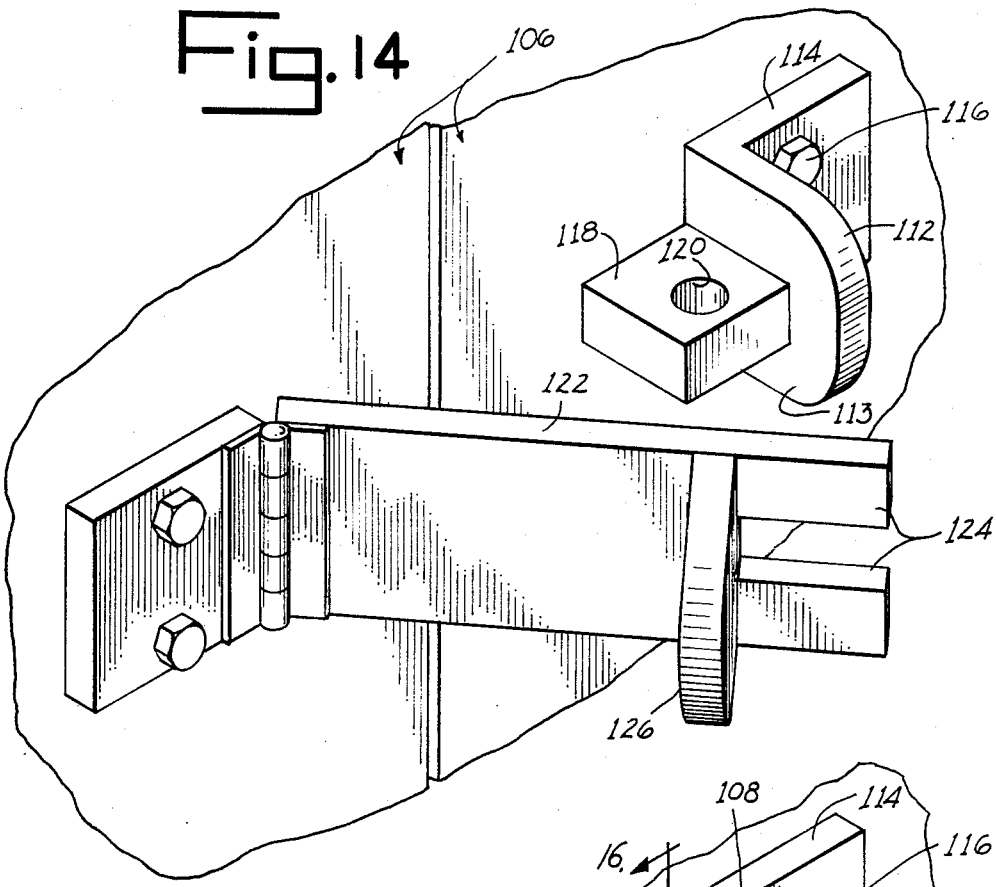
FIG. 14 is a perspective view of another embodiment of the padlock protector in released position.
Figure 15:
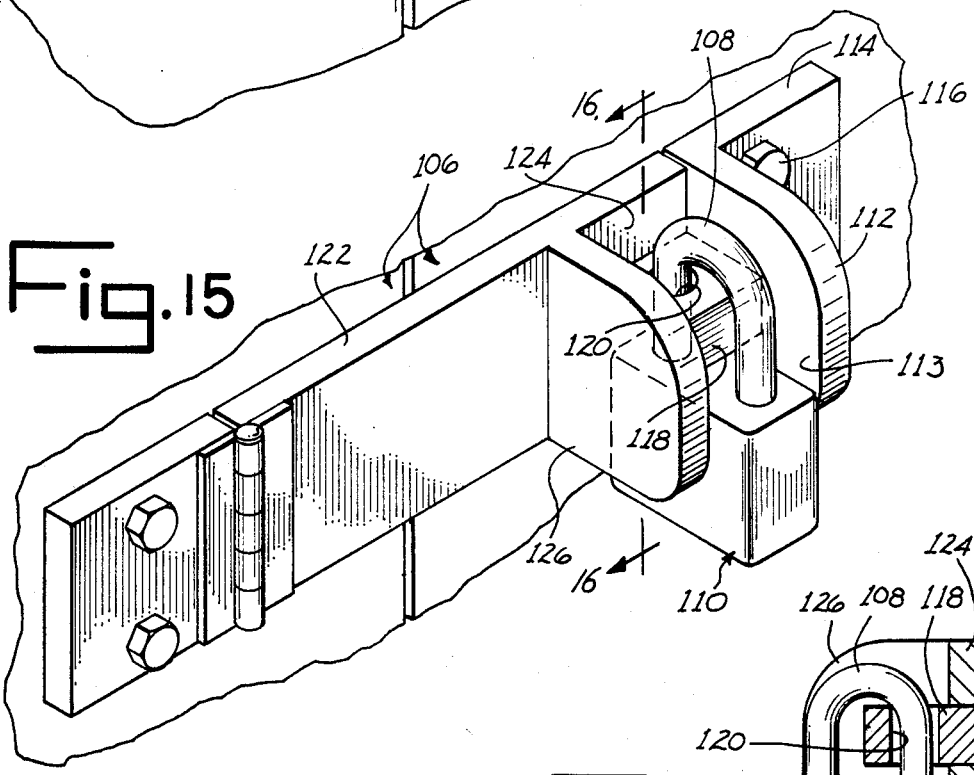
FIG. 15 is a perspective view of the padlock protector of FIG. 14 in its locked position.
Figure 16:
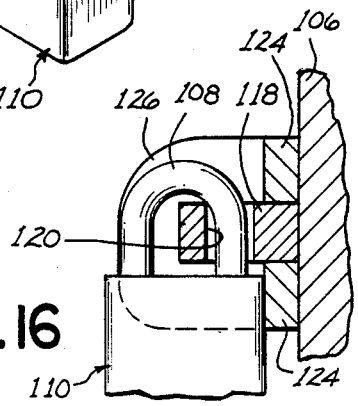
FIG. 16 is a sectional view taken along line 16—16 of FIG. 15.

A fourth embodiment of the padlock protector is illustrated in FIGS. 14–16 to retain double doors 106 in a closed and locked position, while preventing access to the shackle 108 of padlock 110. This embodiment includes a bracket having a vertical retainer flange 112 projecting from a base 114 which is secured to the marginal portion of a door 106, as by bolts 116. A horizontal connector plate 118 projects laterally from the face 113 of flange 112. A bore 120 is formed in plate 118. A retainer or crossbar 122 is hingedly connected to the marginal portion of the opposite door 106, as illustrated in FIGS. 14 and 15. Crossbar 122 extends across the junction of double doors 106 and is forked at its free end at 124 to extend adjacent to flange 112. Forks 124 span plate 18 when crossbar 122 is in locking position (FIG. 15). A second vertical flange 126 projects from crossbar 122 and is spaced from flange 112 when connector plate 118 is received between forks 124. When crossbar 122 is placed in its closed and locked position it lies adjacent to a door 106 and is positioned between the door and bore 120, whereupon shackle 108 of padlock 110 may be inserted into the bore to retain the crossbar 122 in its closed and locked position spanning the junction of double doors 106. As shown in FIGS. 15 and 16, flanges 112,126 are of a size and are proportioned to define a recess for shackle 108, when inserted into bore 120, to protect it from access by a cutting tool, such as bolt cutters.

A fifth embodiment of the padlock protector is shown in FIGS. 17–21. In this embodiment, a flange 128 projects from a retainer base 130 which is secured to the marginal portion of one door 132 of a double door assembly, as by bolts 134. When so fastened, flange 128 preferably extends horizontally from door 132. A bore 136 is formed in flange 128. A retainer or crossbar 138 is hingedly connected at one end, as at 140, to the marginal portion of the opposite door 132 of the double door assembly, and pivots in a vertical plane. Crossbar 138 carries at its other end spaced transverse projecting flanges 142 joined by vertically spaced connector plates 144. Each connector plate 144 has a bore 146 formed therein aligned with the other bore. Each flange 142 has a recess formed therein to receive flange 128 when crossbar 138 is shifted as indicated by arrow 150 of FIG. 18, to a position in which flange 128 is received between connector plates 144. A handle 152 projects from the outermost flange 142. When flange 128 is received between connector plates 144, bore 136 of flange 128 and bores 146 of plates 144 are aligned to receive the shackle 154 of a padlock 156 to secure cross bar 138 to flange 128 in a closed and locked position wherein the shackle 154 is confined between and protected by flanges 142.

It is to be understood that the invention is not to be limited by the terms of the above description but may be modified within the scope of the appended claims.

I claim:

1. In combination, a padlock and a padlock protector for locking two relatively movable objects in a fixed relationship, said padlock including a shackle projecting from a housing when locked, said protector including first and second retainer members, said first retainer member being secured to one of said objects and having a part projecting from said object, said second retainer member being secured to the other object, and including a part projecting from said second retainer and positioned in adjacent substantially parallel shackle-receiving relation to said projecting part of said first retainer when said objects are locked in said fixed relationship, one of said members having a bore to receive said shackle in retainer-locking position between said projecting parts when said objects are in closed position, said projecting parts being of a size to receive between them said shackle and a portion of said housing when said padlock is locked with its shackle positioned in said bore.

2. In combination defined in claim 1, wherein both of said retainer members have parts with aperture which register to receive said shackle when said objects are in locking rrelationship.

* * * * *